US005871024A

United States Patent [19]

Vanderminden, Sr.

[11] Patent Number: 5,871,024

[45] **Date of Patent: *Feb. 16, 1999**

[54] UMBRELLA FRAME AND UMBRELLA FOR OUTDOOR FURNITURE

[75] Inventor: Robert D. Vanderminden, Sr., Granville, N.Y.

[73] Assignee: Telescope Casual Furniture Company, Granville, N.Y.

[ * ] Notice: The term of this patent shall not extend beyond the expiration date of Pat. No. 5,711,333.

[21] Appl. No.: 968,315

[22] Filed: Nov. 12, 1997

Related U.S. Application Data

[63] Continuation-in-part of Ser. No. 788,502, Jan. 29, 1997, Pat. No. 5,711,333.

[51] Int. Cl.[6] ..... H45B 17/00

[52] U.S. Cl. ..... 135/20.1; 135/20.3; 135/25.33; 135/98; 135/155

[58] Field of Search ..... 135/16, 20.1, 20.3, 135/25.33, 26, 38, 98, 114, 117, 155

[56] References Cited

U.S. PATENT DOCUMENTS

| | | | |
|---|---|---|---|
| 437,336 | 9/1890 | Giebel | 135/155 X |
| 459,644 | 9/1891 | McCandless | 135/155 X |
| 534,058 | 2/1895 | Ackermann et al. | 135/98 |
| 1,200,599 | 10/1916 | Erickson | 135/39 |
| 1,801,913 | 4/1931 | Frederick | 135/155 X |
| 3,161,990 | 12/1964 | Morris, Jr. | 135/98 X |
| 4,011,881 | 3/1977 | Becher | 135/98 X |
| 4,424,824 | 1/1984 | Bercher | 135/20.3 |
| 4,637,415 | 1/1987 | Dalo et al. | 135/98 |
| 4,813,442 | 3/1989 | Haines | 135/98 |
| 4,878,509 | 11/1989 | Tung | 135/98 X |
| 5,152,495 | 10/1992 | Jacinto et al. | 135/98 X |
| 5,361,792 | 11/1994 | Lin et al. | 135/25.1 X |
| 5,437,297 | 8/1995 | Crisman et al. | 135/20.3 X |
| 5,441,065 | 8/1995 | Lin et al. | 135/20.3 X |
| 5,752,534 | 5/1998 | Becher | 135/22 X |

FOREIGN PATENT DOCUMENTS

| | | | |
|---|---|---|---|
| 3136357 | 3/1983 | Germany | 135/20.3 |

*Primary Examiner*—Carl D. Friedman
*Assistant Examiner*—Winnie S. Yip
*Attorney, Agent, or Firm*—McAulay Nissen Goldberg Kiel & Hand, LLP

[57] ABSTRACT

The umbrella frame is provided with a movable yoke at the upper end and a stationary yoke at an intermediate point. Ribs are pivotally mounted on the movable yoke and struts are pivotally mounted on the fixed yoke while being pivotally mounted to intermediate points on the ribs. A downward movement of the upper yoke causes the ribs to splay outwardly so as to open the umbrella. An articulated lever and link arrangement is connected to one rib and strut unit so that actuation of the lever causes the upper yoke to be pulled downwardly to open the umbrella. Passage of the lever by a bottom dead center position effects locking of the movable yoke in the lowered position.

17 Claims, 4 Drawing Sheets

UMBRELLA FRAME AND UMBRELLA FOR OUTDOOR FURNITURE

This application is a continuation-in-part application of Ser. No. 08/788,502 filed Jan. 29, 1997, now U.S. Pat. No. 5,711,333.

This invention relates to an umbrella frame and to an umbrella for outdoor furniture.

As is known, various types of umbrella frames have been used for making umbrellas suitable for outdoor use. For example, a typical umbrella has been constructed with a vertical pole on which a yoke assembly is fixed near the top of the pole and is provided with radiating ribs which can be directed outwardly of the pole or collapsed toward the pole by an actuating mechanism. Generally, such an actuating mechanism employs a second yoke which is movable vertically along the pole and struts which connect the movable yoke to the ribs. Suitable crank assemblies have also been provided to crank the movable yoke from a rest position to a raised position in order to cause the struts to splay the ribs attached to the upper fixed yoke upwardly and outwardly. These crank assemblies have employed a cord to lift the movable yoke by securing one end of the cord to the crank mechanism and the opposite end to the movable yoke after passing over a pulley located near the top of the pole. Thus, cranking of the crank assembly allows the movable yoke to be pulled upwardly along the pole via the cord when the umbrella is to be opened.

In the past, umbrella constructions of the above type have been relatively cumbersome to use for outdoor use, particularly for the raising and lowering of a cover attached to the radiating ribs.

Further, the known umbrella constructions have typically had the umbrella cover secured not only to the ends of the ribs but also to intermediate points of the ribs. As a a result, when in a fully open position, the umbrella cover takes on a segmented pie-shaped configuration rather than a smooth draped appearance. Still further, since the covers have been attached at a multiplicity of points to the ribs of the umbrella frame, removal of the covers for replacement or cleaning purposes should be covers become torn or soiled over a period of use has been difficult.

Umbrellas have also been known, such as described in U.S. Pat. No. 5,711,333 wherein an umbrella frame is constructed with a fixed yoke at an intermediate point on a pole and a movable yoke which is mounted above the fixed yoke on the pole with means for moving the movable yoke along the pole between a raised position and a lowered position relative to the fixed yoke. Various ribs and struts are attached to the yokes so that the struts cause the ribs to splay outwardly of the pole in response to movement of the movable yoke to a lowered position. A cord is also attached at one end to the movable yoke while the other end is attached to a crank assembly so that the movable yoke can be moved by means of the crank assembly.

However, one problem that can be associated with umbrellas which use cords for the raising and lowering of an umbrella frame is that the cords can break or become detached from a yoke or crank assembly.

Accordingly, it is an object of the invention to provide an improved umbrella frame construction to simplify the raising and lowering of a cover.

It is another object of the invention to avoid use of a crank to raise or lower an umbrella frame.

It is another object of the invention to eliminate a need for a cord to raise or lower a movable yoke of an umbrella frame.

It is another object of the invention to be able to readily remove a cover from an umbrella for replacement or cleaning purposes.

It is another object of the invention to reduce the time required to raise the cover of an umbrella to a fully opened position.

Briefly, the invention is directed to an umbrella frame which has a pole, a first yoke fixedly mounted on the pole and a second yoke which is movably mounted on the pole above the fixed yoke to move between a remote raised position and a distal lowered position relative to the fixed yoke.

In addition, the umbrella frame has a plurality of radially disposed ribs, each of which is pivotally connected at one end to the movable yoke to move therewith as a well as a plurality of radially disposed struts each of which is pivotally connected at one end to the fixed yoke while also being pivotally connected at an opposite end to an intermediate point of a respective one of the ribs. The ribs and struts are interconnected so that the struts cause the ribs to splay outwardly of the pole in response to movement of the movable yoke to a distal position relative to the fixed yoke, i.e. the lowered position. The struts also cause the ribs to collapse in response to movement of the movable yoke to a remote position relative to the fixed yoke, i.e. the raised position.

A cover is also provided over the ribs of the umbrella frame being attached at the outer periphery to the outer ends of the ribs and being mounted at an inner periphery on the pole of the umbrella frame.

In accordance with the invention, an articulated lever means is provided for moving the movable yoke between the raised position and the lowered position relative to the fixed yoke.

The articulated lever means is constructed to avoid the need to use cords or a winding apparatus for winding up a cord in order to manipulate the movable yoke. In particular, the articulated lever means is incorporated into the ribs and strut environment of the umbrella so as to provide a compact structure which is readily manufactured and assembled.

The articulated lever means includes a lever which is pivotally connected at an upper end to one of the ribs of the frame and a link which is pivotally connected at one end to one of the struts of the frame while being pivotally connected at an opposite end to an intermediate point of the lever. The arrangement is such that the link is pivotable on the strut to move between an upright position with the movable yoke in the raised position thereof and a depending position with the movable yoke in the lowered position thereof.

From a geometric standpoint, the lever is connected to the rib on a first axis of rotation to pivot in a plane radial of the pole. The link is connected to the strut on a second axis of rotation parallel to the axis of rotation of the lever and is connected to the lever on a third axis of rotation parallel to and spaced from the axis of rotation of the lever. In this respect, the third axis is disposed between the first and second axes when the movable yoke is in the raised position and is disposed below the first and second axes when the movable yoke is in the lowered position.

In order to move the movable yoke from the raised position, i.e. the collapsed position of the umbrella, a rib is first pivoted in a direction away from the umbrella pole. This causes the movable yoke to move downwardly from the raised position towards the fixed yoke while the cover splays outwardly. This also causes the lever to pivot outwardly and the link to pivot on the strut in a direction radially away from the pole to a point at which the link begins to pivot towards the pole. At this point, the lever is exposed from under the cover and is grasped and pulled downwardly while at the same time being pivoted towards the pole in order to move the movable yoke into the lowered position. Once the three axes of rotation are aligned in a common plane, i.e. a "dead center" position of the lever, continued motion of the lever towards the pole locks the articulated lever means in place and, at the same time, makes the cover taut. A positive force is then necessary to move the lever outwardly of the pole in order to collapse, i.e. close, the umbrella.

In order to collapse the umbrella from the opened condition, the lever of the articulated lever means is moved radially outwardly of the pole past the "dead center" position of the three axes of rotation and then released. At this time, the umbrella will move into the collapsed position under the force of gravity due to the weight of the ribs, struts and cover.

The pole may also be provided with a tilt mechanism for securing separate sections of the pole together in one of a plurality of selected angular positions relative to each other.

The pole, ribs and struts of the umbrella may all be made of solid or hollow construction. Also, the pole, ribs and struts may each be made of wood. Further, each rib may be provided with a tapered end to which a male snap-fastener element is secured in order to mate with a female snap-fastener element on a cover disposed over the ribs. The tapered ends of the ribs have been found to facilitate the folding of the cover during opening and closing of the umbrella. That is to say, during opening of an umbrella, the fabric of the cover may twist about the end of each rib. If sharp comers were provided at the ends of the ribs, there is a risk that the fabric of the cover might catch on the comers thereby impeding opening of the umbrella. By tapering the ends of the ribs, smooth surfaces are provided to avoid catching of the cover and to allow any twisted fabric of the cover to move smoothly over the ends of the ribs into the open condition.

These and other objects and advantages of the invention will become more apparent from the following detailed description taking in conjunction with the accompanying drawings wherein.

Figure 1:
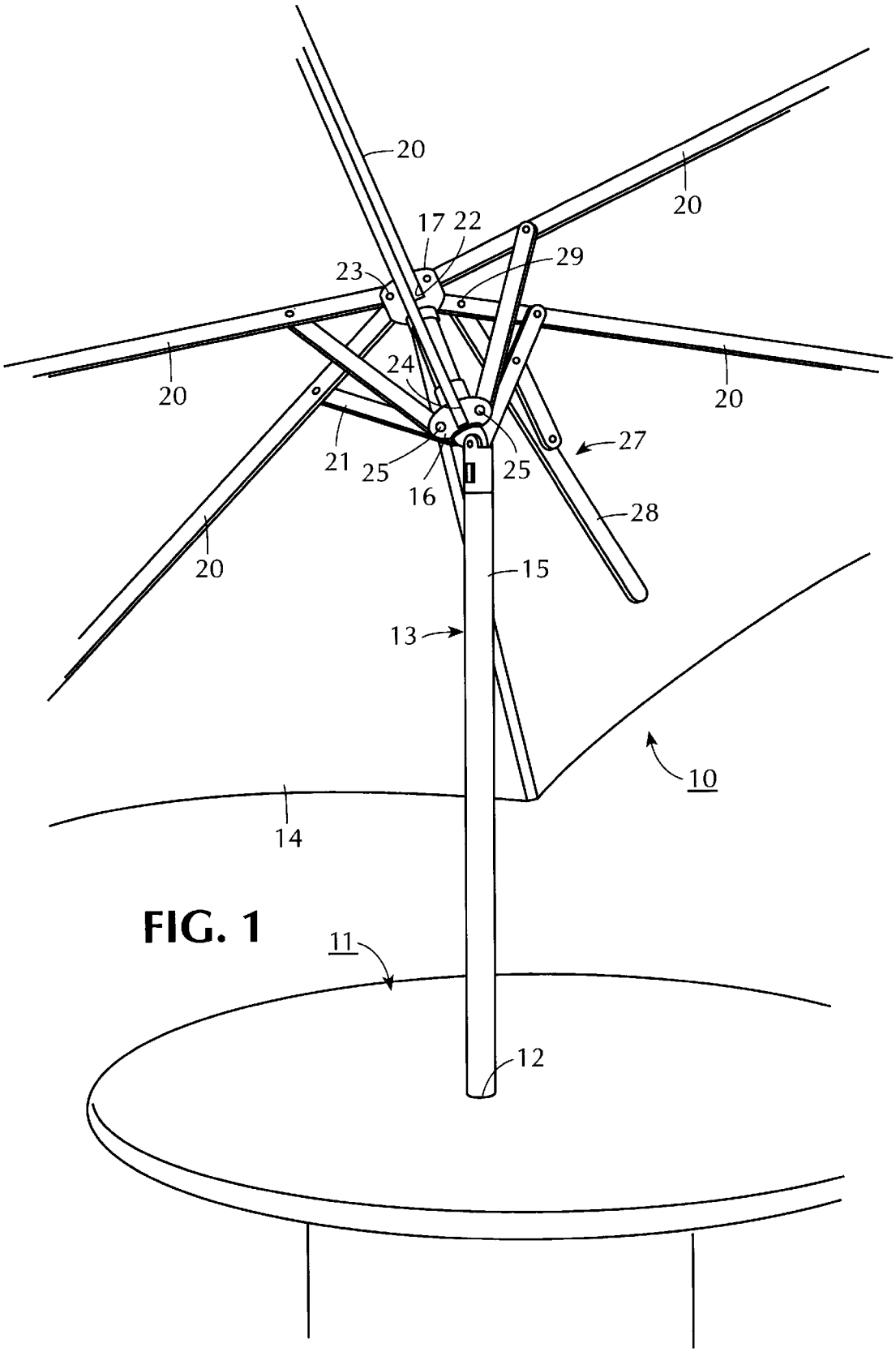
FIG. 1 illustrates a perspective view of an umbrella constructed in accordance with the invention in a tilted position in association with an outdoor table.

Referring to FIG. 1, the umbrella 10 is constructed and sized for use with outdoor furniture, particularly a table 11 having an aperture 12 in a center region to receive the umbrella 10. Such a use is conventional and need not be further described.

As indicated in FIG. 1, the umbrella 10 is formed of a frame 13 and a cover 14 as more particularly described below.

Figure 2:
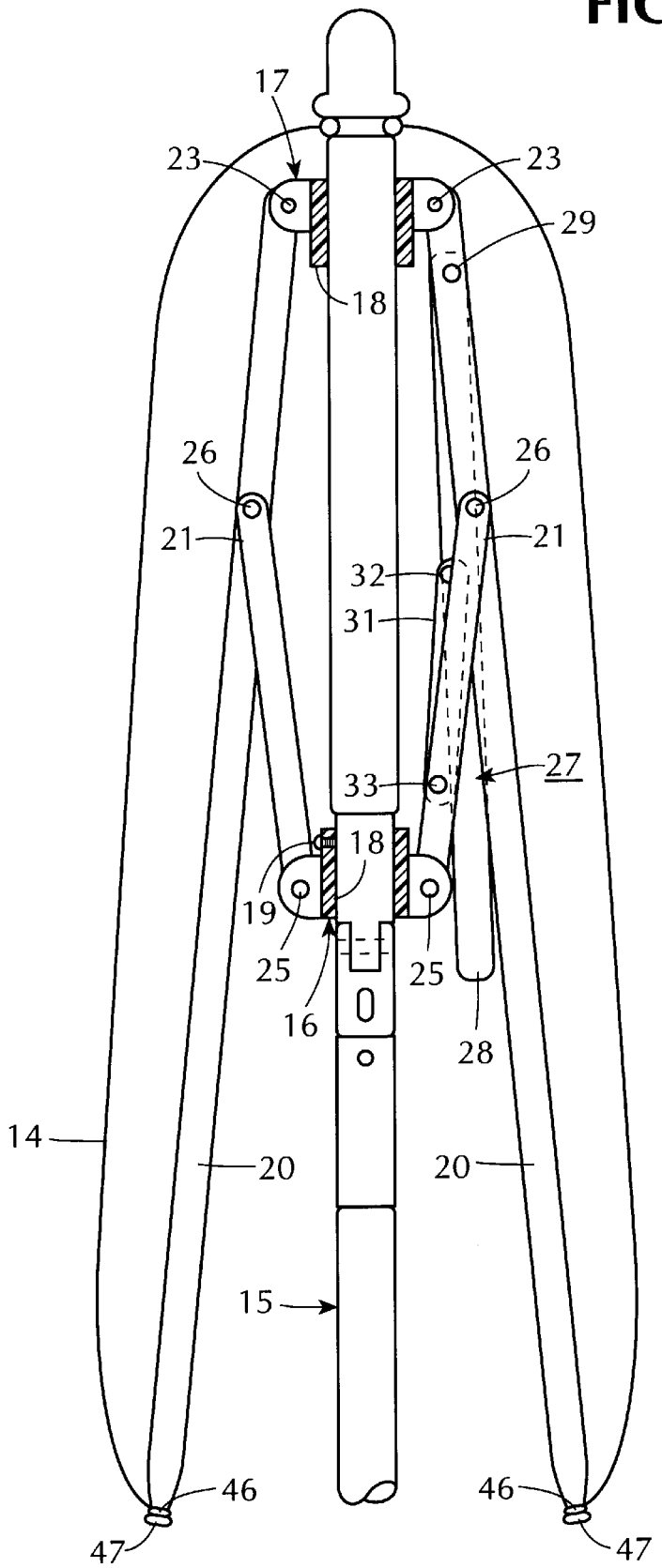
FIG. 2 illustrates a part cross-sectional view of the umbrella of FIG. 1 in a collapsed position.
Figure 3:
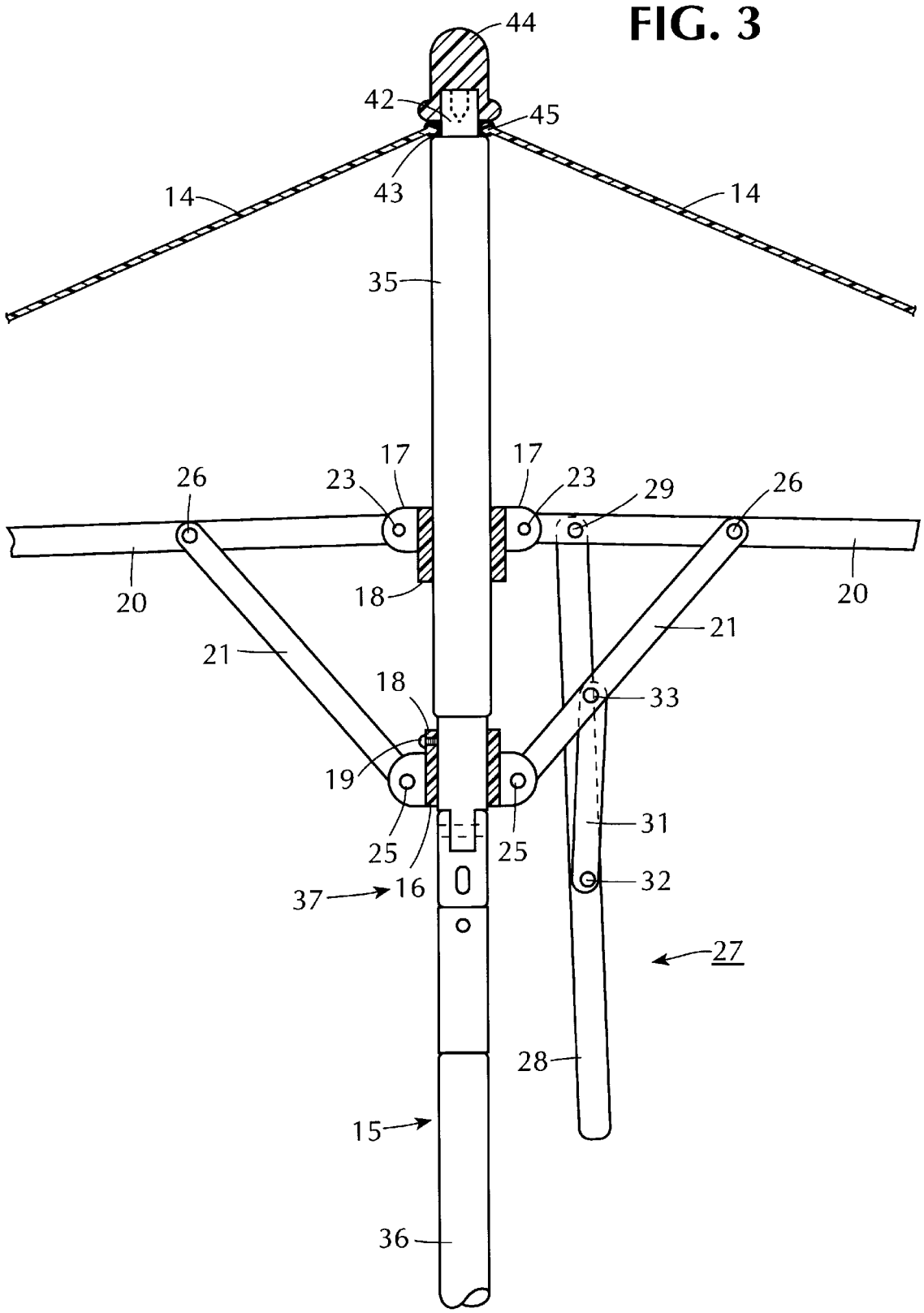
FIG. 3 illustrates a cross-sectional view of the umbrella of FIG. 1 in an opened position.

Referring to FIGS. 2 and 3, the umbrella frame 13 includes a pole 15, e.g. of solid wood construction, which is to be vertically mounted, a first one piece yoke 16 which is fixedly mounted on the pole 15 at an intermediate point and a second one piece yoke 17 which is movably mounted on the pole 15 above the fixed yoke 16 to move relative to the fixed yoke 16 between a raised position (FIG. 2) remote from the fixed yoke 16 and a lowered position (FIG. 3) distal of the fixed yoke 16.

As indicated in FIG. 2, the fixed yoke 16 which may be made of plastic and has a cylindrical collar 18 which is secured to the pole 15 via a screw 19 which is passed through the collar 18 into threaded engagement with the pole 15. The upper movable yoke 17 is of similar construction but is not secured to the pole 15.

A plurality of radially disposed ribs 20 are pivotally connected at one end to the movable yoke 17 while a plurality of radially disposed struts 21 are pivotally connected at one end to the fixed yoke 16 and at the opposite ends to intermediate points on the ribs 20. Each rib 20 is of solid rectangular cross-section and is made, for example of wood. Each rib 20 also has an upper end removably and pivotally secured within a slot 22 (see FIG. 1) in the movable yoke 17 by means of a pivot 23 in the form of a threaded screw. For example, the screw 23 has a threaded shank passing through a shouldered part of the yoke 17 and through the rib 20 into threaded engagement with a side wall of the slot 22 while a head of the screw 23 abuts against the shouldered part of the yoke 17. In this way, removal of the screw 23 would permit replacement of a rib 20 as required. Alternatively, a fixed pin arrangement may be used to pivotally mounted the end of the rib 20 in the yoke 17.

Each strut 21 is of solid rectangular cross-section and is made of wood. Each strut 21 also has a lower end removably and pivotally secured within a slot 24 (see FIG. 1) of the fixed yoke 16 by a pivot, such as a screw 25, in a manner as described above with respect to the mounting of a rib 20 in the movable yoke 17.

The opposite end of each strut 21 is also pivotally connected to a respective rib 20 in side-by-side relation by a pivot pin or rivet 26 which passes through a respective strut 21 and rib 20. A washer (not shown) may also be sandwiched between each rib 20 and strut 21 on the pivot pin 26.

Each unit comprised of a rib 20 and strut 21 may be removed from the yokes 16, 17 by removing the mounting screws 23, 25 for repair or replacement purposes.

The articulation of the ribs 20 and struts 21 to the yokes 16, 17 is such that when the movable yoke 17 is moved downwardly from the raised position shown in FIG. 2 to the lowered position shown in FIG. 3, the ribs 20 move from the collapsed position shown in FIG. 2 to the outwardly splayed position indicated in FIG. 3.

Referring to FIGS. 2 and 3, the umbrella 10 also has a manually operable articulated lever means 27 for moving the movable yoke 17 along the pole 15 between the raised (remote) position and the lowered (distal) position relative to the fixed yoke 16.

This lever means 27 includes an elongated lever 28 which is pivotally and permanently connected at the upper end via a pivot or rivet 29 to one of the ribs 20. As illustrated in FIG. 3, the pivot 29 is offset to the right of the center line of the lever 28 while passing through the center line of the rib 20. A washer 30 may also be provided between the lever 28 and rib 20 about the pivot 29. The lever 28 extends downwardly and slightly outwardly of the collapsed ribs 20 to be manually accessible.

The articulated lever means 27 also includes a link 31. As illustrated in FIG. 3, the link 31 is pivotally and permanently connected at the lower end via a pivot 32 to the lever 28. As indicated, the pivot 32 is on an axis of rotation which is offset from the center line of the lever 28, that is to the left of the center line. The opposite end of the link 31 is permanently connected by a pivot 33 to an intermediate point of a strut 21 which is connected to the rib 20 to which the lever 28 is pivotally connected. As shown, the rivet 33 is located on an axis of rotation which is offset to the right of the center line of the link 31. The link 31 is pivotable on the strut 21 to move between an upright position (FIG. 2) with the movable yoke 17 in the raised position and a depending position (FIG. 3) with the movable yoke 17 in the lowered position.

In the positions shown in FIG. 3, the link 31 is aligned with the rib 20 while the lever 28 is pivotally connected to the rib 20 on a side opposite from the strut 21.

Referring to FIG. 2, the lever 28 of the articulated lever means 27 is of a length which is shorter than the length of a rib 20, e.g. approximately the one half the length of a rib 20. The link 31 is, for example, about the length of a strut 21. When the lever means 27 is in a collapsed position as illustrated in FIG. 2 coincident with the raised position of the movable yoke 17, the axis of rotation of the link 31 is located between the axis of rotation of the lever 28 relative to the rib 20 and the axis of rotation of the link 31 relative to the strut 21. When the articulated lever means 27 is in the umbrella-opened condition as shown in FIG. 3, the axis of rotation of the link 31 along the lever 28 is moved below the axis of rotation of the link 31 on the strut 21.

The link 31 is rounded at both ends and particularly the end which is to move past the rib 20 in order to have the link 31 clear the rib 20 during movement thereby.

Figure 4:
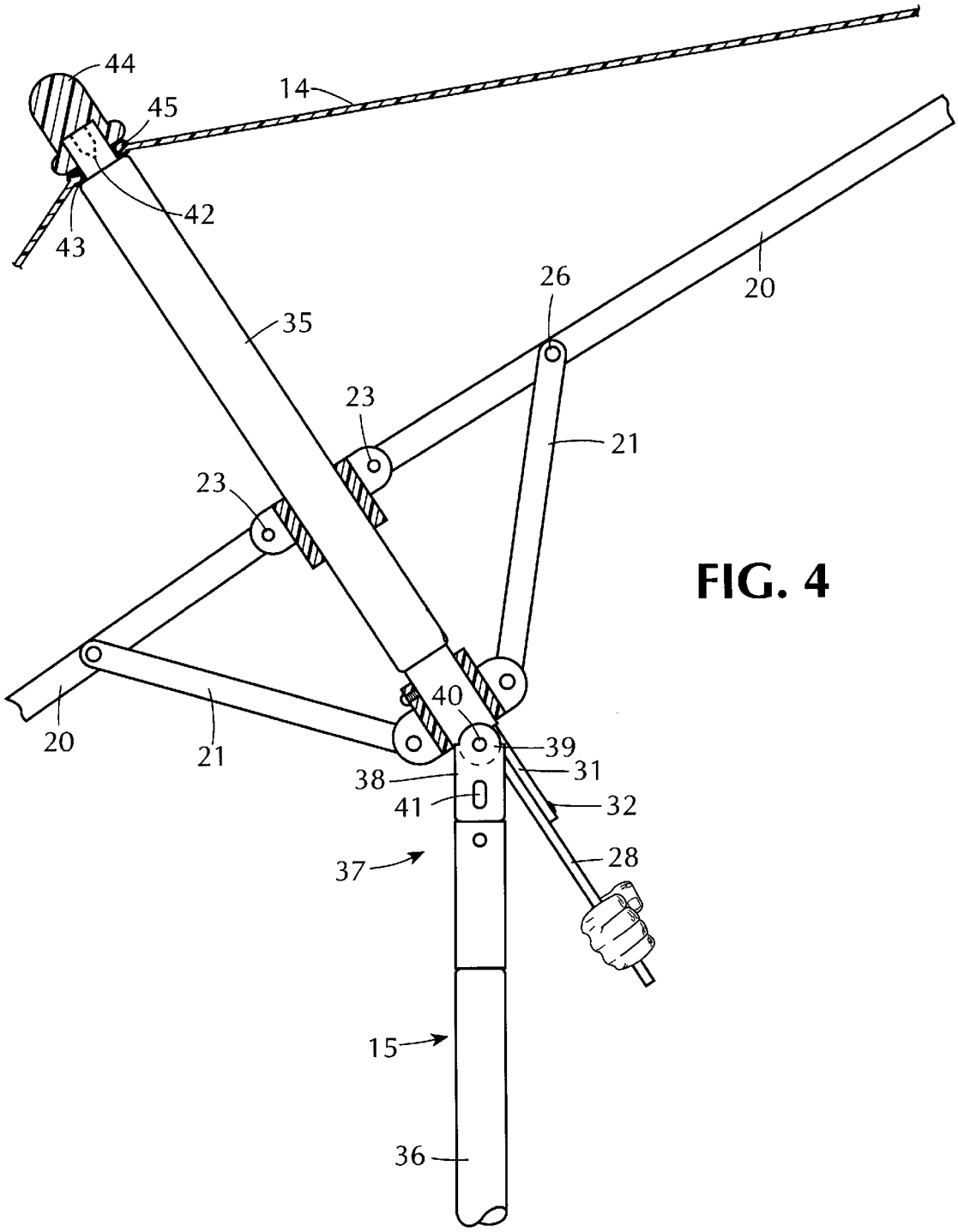
FIG. 4 illustrates a side view of a portion of the articulated lever means constructed in accordance with the invention.

Referring to FIGS. 3 and 4, the pole 15 has an upper section which has two coaxial portions 35, 36 which are articulated together by a conventional tilt mechanism 37 so that the upper portion 35 can be tilted into a selected one of several angular position, relative to the lower portion 36, for example as shown in FIG. 1. In this respect, the tilt mechanism 37 includes a bifurcated piece 38 mounted on the fixed lower pole portion 36 and a stem 39 mounted on the lower end of the upper tiltable portion 35. The stem 39 is pivotally mounted via a pivot pin 40 in the bifurcated piece 38 and a manually operated slide lock 41 is provided to lock the stem 39 in one of three positions relative to the bifurcated piece 38. For example, the lock 41 includes a detent (not shown) which is able to fit into one of three slots (not shown) in the stem 39. One slot is disposed centrally of the stem 39 to align the upper portion 35 with the lower portion 36; a second slot is provided to the left of the central slot to permit tilting of the upper portion 35 to one side relative to the lower portion 36; and the third slot is similarly located to the opposite side of the central slot.

The pole 15 also includes an elongated section (not shown) which is removably connected to the upper pole section and functions as an extender for the the pole 15.

Referring to FIG. 3, the upper end of the pole 15 is provided with a post 42 of reduced diameter to define an annular shoulder 43 at the top of the pole 15. A decorative retaining knob 44 is threaded into the post 42 for purposes as described below.

As shown in FIG. 3, the cover 14 has a ring 45, for example of metal, in a central area which is concentrically mounted about the post 42 to rest on the shoulder 43. As illustrated, the ring 45 is held in place by the retaining knob 44.

The cover 14 is made of any suitable fabric or material, such as cloth, and is secured at a plurality of peripherally disposed points to the ribs 20 of the umbrella frame. As indicated in FIG. 2, snap fastener elements are used to secure the periphery of the cover 14 to ends of the ribs 20. For example, the end of each rib 20 is provided with a male snap fastener element 46 while the cover 14 is provided with a female snap fastener element 47 to snap fit over the male snap fastener element 46. As indicated, the free end of each rib 20 is tapered to facilitate folding in and folding out of the cover sections as the umbrella 10 is opened and closed.

As illustrated in FIG. 4, the lever 28 is disposed perpendicularly of the plane in which the tilt mechanism 37 tilts. In this position, the lever 28 can be used to facilitate tilting of the upper section 35 of the pole 15 relative to the lower section 36 by helping to tilt the upper pole portion 35 from one side to another after release of the lock 41.

In use, with the umbrella in a closed position as illustrated in FIG. 2, the movable yoke 17 is in the raised position. At this time, the link 31 of the articulated lever means 27 is in a raised position. When the umbrella is to be opened, the user pulls up on one or more of the ribs 20 until the ribs 20 attain a somewhat splayed out position and the lever 28 is exposed to a degree sufficient to be grasped by the user. During this time, the link 31 rotates in a clockwise direction as viewed in FIG. 2 while the movable yoke 17 moves downwardly along the pole 15. With the lever 28 exposed, the user grasps the lever 28 and pulls the lever 28 in a direction perpendicular to the pole 15. This causes the lever 28 to continue to pivot about the axis of the rivet 29 while also causing the link 31 to continue to rotate in a clockwise direction as viewed in FIG. 2. This motion also causes the movable yoke 17 to move downwardly toward the fixed yoke 16. Outward pivoting of the lever 28 continues to a point at which the link 31 is substantially horizontal. At this time, the lever 28 is pulled downwardly by the user while also being pivoted toward the pole 15. During this time, the ribs 20 continue to splay outwardly while the movable yoke 17 continues to move downwardly toward the fixed yoke 16.

As the movable yoke 17 approaches the lowered position illustrated in FIG. 3, the link 31 moves into a position to depend from the strut 21. At one point, the axis of rotation of the rivet 29, the axis of rotation of the rivet 33 and the axis of rotation of the rivet 32 move into a common plane to establish a "dead center" position of the lever 28. The lever 28 is manually pushed beyond this position closer to the pole 15 in order to lock the movable yoke 17 in place. Accordingly, the weight of the frame including the ribs 20 and struts 21 which would otherwise bias the movable yoke 17 in an upward direction is used to retain the movable yoke 17 fixed, i.e. in the position as shown in FIG. 3.

As the lever 28 moves into the "dead center" position, the movable yoke 17 is moved close to its final lowered position. During this time, the cover is being tightened. In order to complete the downward movement of the yoke 17, a force is applied to the lever 28 to move passed the "dead center" position thereby bringing the movable yoke 17 to the lowermost position while at the same time making the cover 14 taut. It is to be noted that the lever 28 provides a large mechanical advantage at the end of the downward excursion of the movable yoke 17. Further, this large mechanical advantage is provided where needed in order to tighten the cover 14.

In order to collapse the umbrella, the lever 28 is manually grasped and pivoted outwardly from the pole 15 from the position shown in FIG. 3. After passing the "dead center" position, the lever 28 can be released so that the weight of the ribs 20, struts 21 and cover 14 cause the umbrella to close thereby moving the yoke 17 into the position shown in FIG. 2.

During closing of the umbrella 10, the cover 14 drapes about the ribs 20 while loosening. Thus, when the umbrella 10 is in the collapsed position, the cover 14 is not under tension. This allows for easy removal of the cover 14, for example for cleaning purposes. In this respect, in order to remove the cover 14, the knob 44 is simply unthreaded from the post 42 and the female snap fastener elements 47 unsnapped from the male fastener elements 46. The cover is then completely detached from the umbrella frame and may be separately cleaned. Mounting of the cover 14 takes place with a reverse procedure.

The articulated lever mechanism provided by the invention is relatively simple. Further, in the case of breakage of the means, a single unit of one rib 20, one strut 21 and the lever means 27 can be removed by unthreading of the screws which hold the rib 20 and strut 21 to the yokes 16, 17. A new unit can then be put in place in a reverse manner.

The invention thus provides an umbrella of relatively simple construction readily opened. In addition, the invention provides a relatively simple means for opening and closing an umbrella which does not require cords and/or crank mechanisms. Further, the use of a simple pull down technique on the movable yoke of the umbrella allows the umbrella to be extended from the collapsed position to the outwardly splayed position in an easy movement in a minimum period of time.

The various parts of the umbrella such as the pole, ribs and struts can be made of solid wood to create a pleasing aesthetic appearance to the umbrella. Alternative, the components of the pole, ribs and struts may be made of other suitable materials and may be of hollow construction.

The invention further provides a relatively simple articulated lever means for opening and closing an umbrella and for providing a relatively taut cover when in the opened condition.

What is claimed is:

1. An umbrella frame comprising a pole;

a first yoke fixedly mounted on said pole at an intermediate point thereof;

a second yoke movably mounted on said pole above said first yoke;

a plurality of radially disposed ribs, each rib being pivotally connected at one end to said second yoke to move therewith;

a plurality of radially disposed struts, each strut being pivotally connected at one end to said first yoke and being pivotally connected at an opposite end to a respective one of said ribs whereby said struts cause said ribs to splay outwardly of said pole in response to movement of said second yoke to a lowered position relative to said first yoke and said struts cause said second yoke to move towards a raised position relative to said first yoke in response to collapsing of said ribs inwardly under gravity; and an articulated lever means for moving said second yoke along said pole between said raised position and said lowered position relative to said first yoke.

2. An umbrella frame as set forth in claim 1 wherein said articulated lever means for moving said second yoke includes a lever pivotally connected at one end to one of said ribs and a link pivotally connected at one end to one of said struts and pivotally connected at an opposite end to an intermediate point of said lever.

3. An umbrella frame as set forth in claim 2 wherein said link is pivotable on said one strut to move between an upright position with said movable second yoke in said raised position and a depending position with said movable second yoke in said lowered position.

4. An umbrella frame as set forth in claim 2 wherein said lever is connected to said one rib on a first axis of rotation, said link is connected to said one strut on a parallel second axis of rotation and connected to said lever on a parallel third axis of rotation and wherein said third axis is disposed between said first and second axes in said raised position of said second yoke and is disposed below said first and second axes in said lowered position of said movable second yoke.

5. An umbrella frame as set forth in claim 4 wherein said lever is pivotally mounted to pivot on said one rib to align said first, second and third axes on a common line with said third axis below said first and second axes to define a bottom dead center position of said lever.

6. An umbrella frame as set forth in claim 2 wherein said lever pivots in a direction away from said pole to move said movable second yoke from said raised position towards said fixed first yoke and pivots towards said pole to move said movable second yoke into said lowered position.

7. An umbrella frame as set forth in claim 1 wherein said pole includes a first section having said yokes mounted thereon and a second elongated section removably connected to and below said first section.

8. An umbrella frame as set forth in claim 7 wherein each of said first and second sections of said pole is made of wood.

9. An umbrella frame as set forth in claim 8 wherein each of said ribs and each of said struts is made of wood.

10. An umbrella frame as set forth in claim 8 wherein each of said yokes is made of plastic.

11. An umbrella frame as set forth in claim 7 wherein each of said first and second sections is of solid cross-section.

12. An umbrella frame as set forth in claim 1 wherein said pole includes a first portion mounting said yokes thereon, a second coaxial portion below said first portion and a tilt mechanism securing said portions together in one of a plurality of selected angular portions relative to each other.

13. An umbrella comprising a pole;

a first yoke movably mounted on said pole between a raised position and a lowered position;

a plurality of radially disposed ribs, each rib being pivotally connected at one end to said yoke to move between a collapsed position adjacent said pole with said yoke in said raised position and an outwardly splayed position relative to said pole with said yoke in said lowered position;

a cover mounted at a central area on said pole and secured at a plurality of peripherally disposed points to said ribs, said cover being spaced from said ribs between said points and said central area in said outwardly splayed position of said ribs;

a second yoke fixedly mounted on said pole below said movable first yoke;

at least one strut pivotally connected at one end to said second yoke and pivotally connected at an opposite end to a respective one of said ribs whereby said strut causes said one rib to splay outwardly of said pole in response to movement of said first yoke to a lowered position relative to said second yoke and causes said first yoke to move towards a raised position relative to said second yoke in response to collapsing of said one rib inwardly under gravity; and an articulated lever means for moving said first yoke along said pole between said raised position and said lowered position relative to said second yoke.

14. An umbrella as set forth in claim 13 wherein each rib has a tapered end with a male snap fastener element at said end and said cover has a female snap fastener element at each said point thereof removably engaged with a respective male snap fastener element.

15. In an umbrella frame, the combination comprising a pair of coaxially disposed yokes;

a radially disposed rib removably and pivotally connected to one of said yokes;

a radially disposed strut removably and pivotally connected to the other of said yokes and to said rib;

a lever pivotally connected at one end to said rib; and a link pivotally connected at one end to said strut and pivotally connected at an opposite end to an intermediate point of said lever.

16. The combination as set forth in claim 15 which further comprises a first screw threaded into said one yoke to removably and pivotally connect said rib to said one yoke and a second screw threaded into said other yoke to removably and pivotally connect said strut to said other yoke.

17. An umbrella frame as set forth in claim 15 wherein said lever is permanently connected to said rib and said link is permanently connected to said strut and said lever.

* * * * *

UNITED STATES PATENT AND TRADEMARK OFFICE

CERTIFICATE OF CORRECTION

PATENT NO. : 5,871,024

ISSUED : Feb. 16, 1999

INVENTOR(S) : Robert D. Vanderminden, Sr.

It is certified that error appears in the above-identified patent and that said Letters Patent is hereby corrected as shown below:

Column 3, line 23 , change "comers" to -corners-

Column 6, line 56, after "simple construction" insert -which can be-

Signed and Sealed this

Eighth Day of June, 1999

*Attest:*

Q. TODD DICKINSON

*Attesting Officer*

*Acting Commissioner of Patents and Trademarks*